US012703474B2

(12) United States Patent
Curcio

(10) Patent No.: US 12,703,474 B2
(45) Date of Patent: Aug. 11, 2026

(54) ENERGY RECOVERY SYSTEM FOR MARINE VESSELS

(71) Applicant: Mario Curcio, Hochdorf (CH)

(72) Inventor: Mario Curcio, Hochdorf (CH)

( * ) Notice: Subject to any disclaimer, the term of this patent is extended or adjusted under 35 U.S.C. 154(b) by 383 days.

(21) Appl. No.: 18/285,238

(22) PCT Filed: Apr. 10, 2022

(86) PCT No.: PCT/EP2022/059552
§ 371 (c)(1),
(2) Date: Sep. 30, 2023

(87) PCT Pub. No.: WO2022/214704
PCT Pub. Date: Oct. 13, 2022

(65) Prior Publication Data

US 2024/0182149 A1 Jun. 6, 2024

(30) Foreign Application Priority Data

Apr. 10, 2021 (EP) ..... 21020199

(51) Int. Cl.
*B63J 3/04* (2006.01)

(52) U.S. Cl.
CPC ..... *B63J 3/04* (2013.01); *B63J 2003/046* (2013.01)

(58) Field of Classification Search
CPC ..... B63J 3/02; B63J 3/04; B63J 2003/046
See application file for complete search history.

(56) References Cited

U.S. PATENT DOCUMENTS

| | | | | |
|---|---|---|---|---|
| 3,812,379 A * | 5/1974 | Kaufman | ..... | F02B 63/04 290/43 |
| 2005/0106023 A1* | 5/2005 | Palley | ..... | F03D 3/062 416/176 |
| 2007/0051292 A1* | 3/2007 | Kilbourn | ..... | B63H 21/20 114/311 |

FOREIGN PATENT DOCUMENTS

| | | | | |
|---|---|---|---|---|
| CN | 106915425 A | 7/2017 | | |
| CN | 107676214 A | 2/2018 | | |
| CN | 107235112 B | 7/2019 | | |
| DE | 202014006395 U1 * | 11/2014 | ..... | B63J 3/04 |
| JP | S61247594 A * | 11/1986 | | |
| JP | H11222188 A | 8/1999 | | |
| KR | 101323828 B1 | 10/2013 | | |

OTHER PUBLICATIONS

Machine translation of JPS61247594 (Year: 1986).*
Machine translation of DE202014006395 (Year: 2014).*

* cited by examiner

*Primary Examiner* — Brian O Peters

(57) ABSTRACT

An energy recovery system 100 for a marine vessel 200 is herein disclosed comprising at least one water turbine 101, 102 with vertical axis 105, 106 respectively arranged aft and off center, that is either port side or starboard side, with respect to a rotational axis 211 of a respective propeller but at a distance from the propeller and from the rotational axis of the propeller such as to be at least partially in a wake range 21' of the propeller in order to recover at least part of the dissipated rotational power. A vessel 200 comprising at least one energy recovery system 100 and a method for recovering at least part of the energy dissipated by the marine vessel are herein also disclosed.

13 Claims, 10 Drawing Sheets

[Fig. 5]
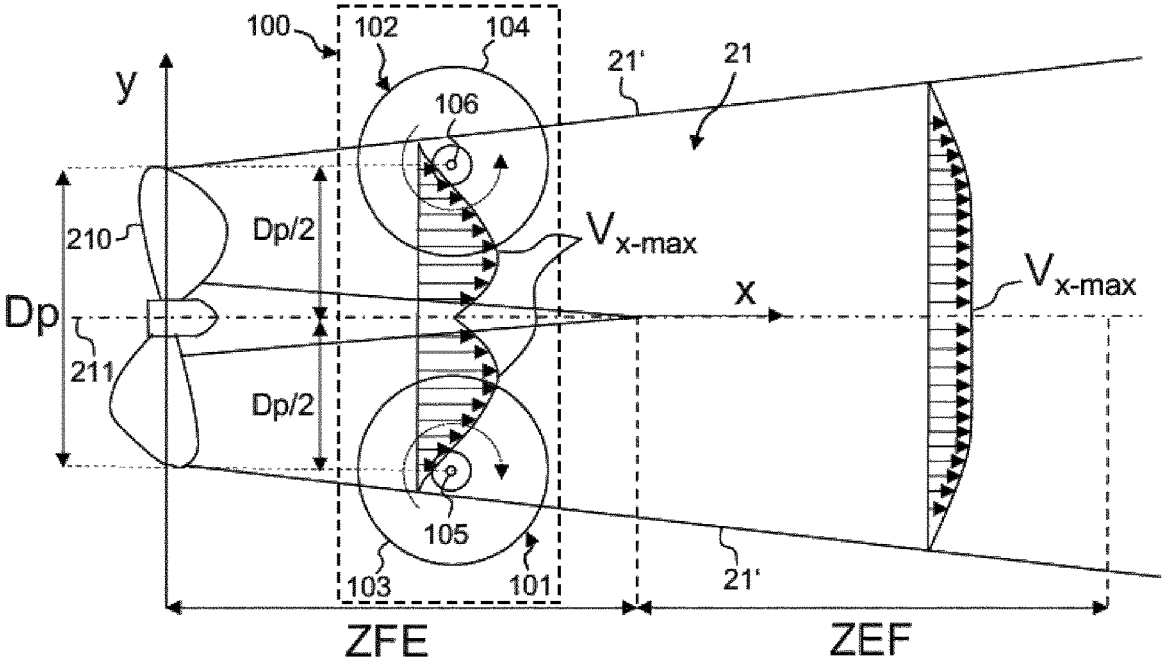
[Fig. 6]
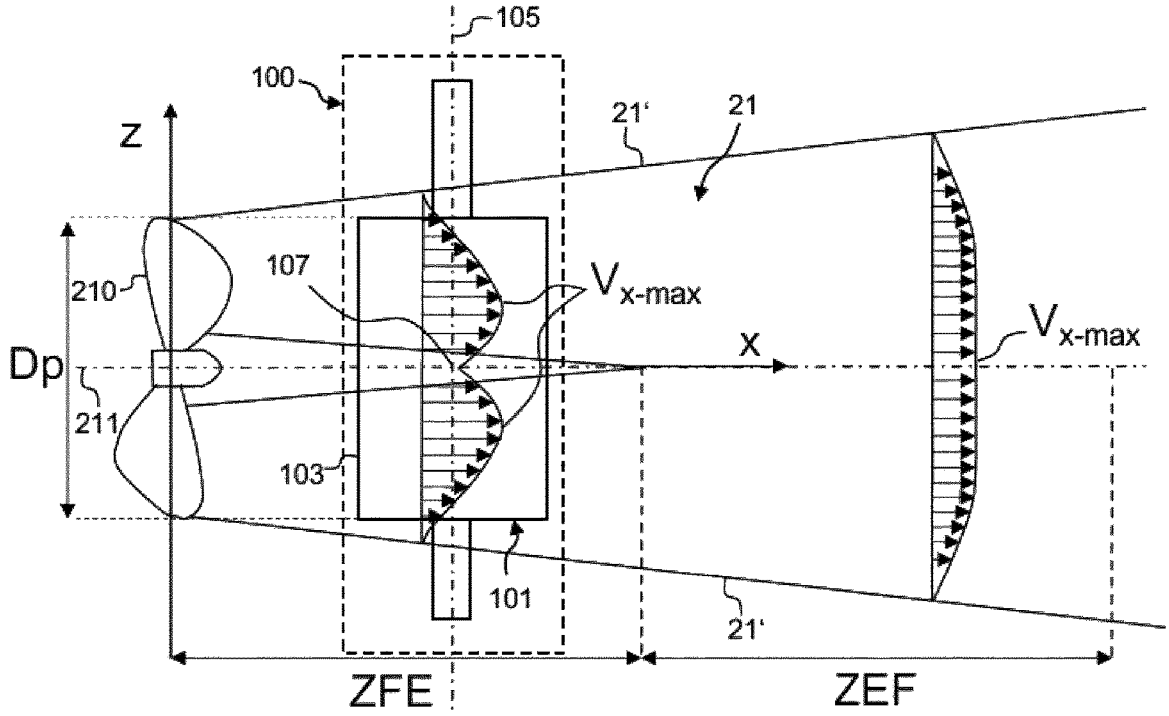

[Fig. 7]
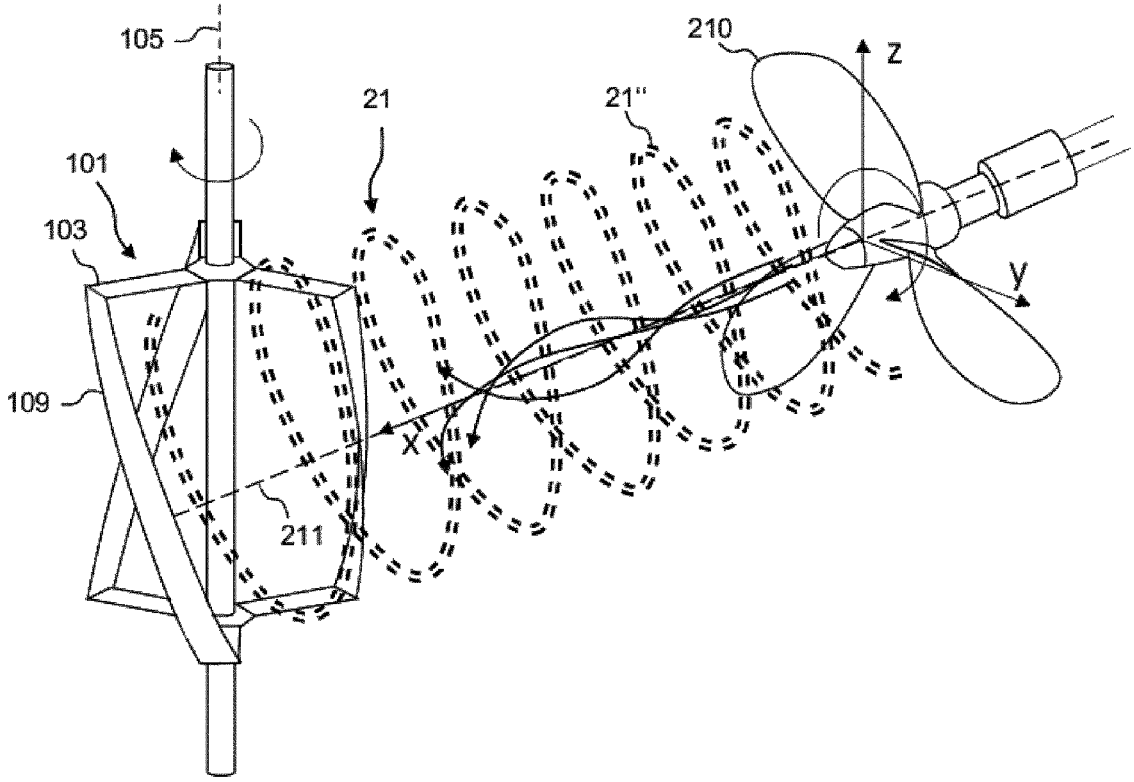
[Fig. 8]
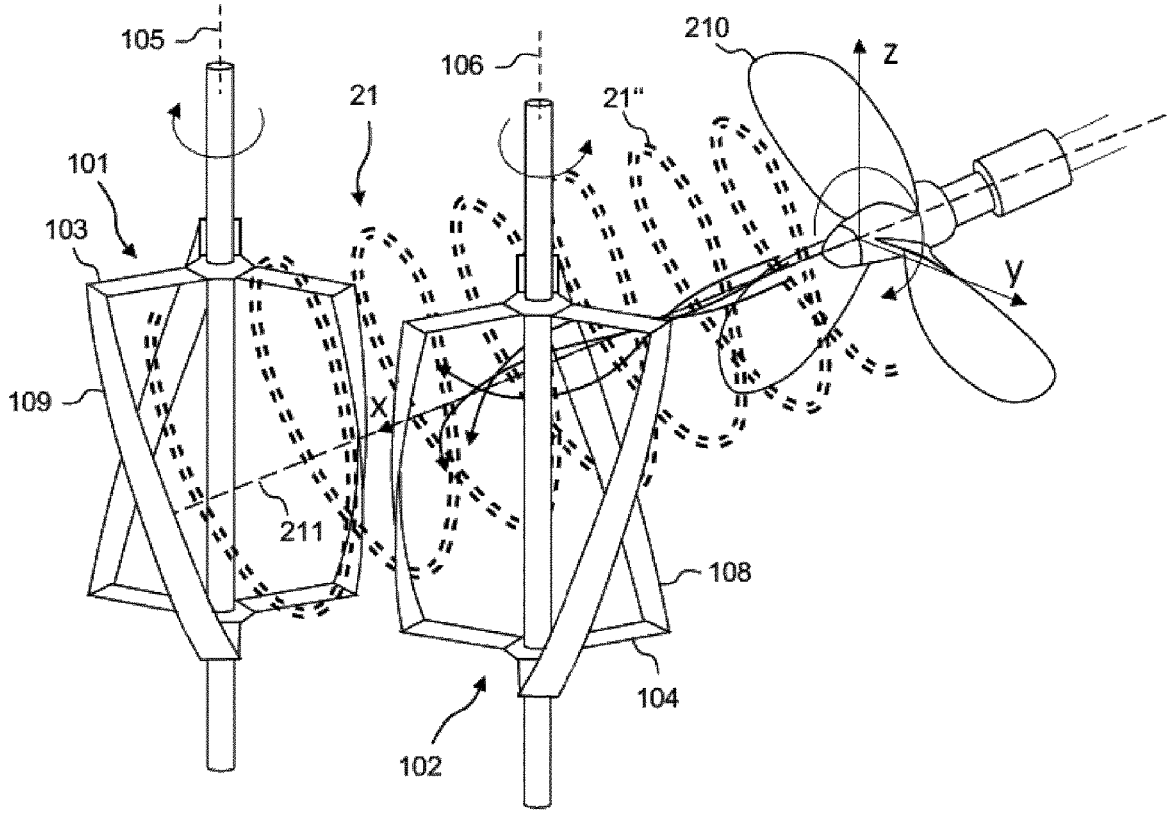

[Fig. 9]
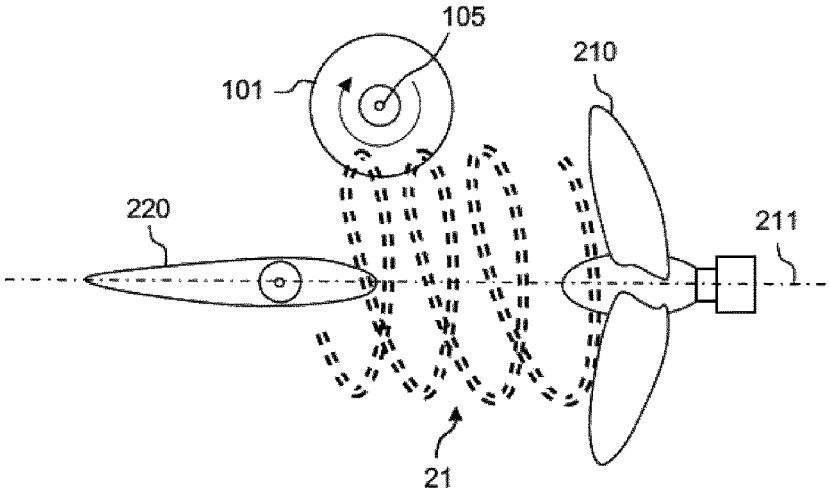
[Fig. 10]
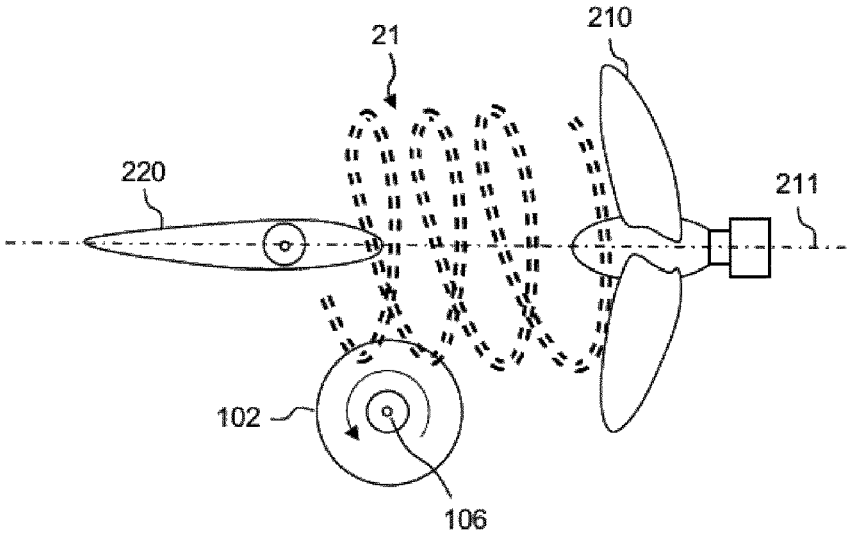
[Fig. 11]
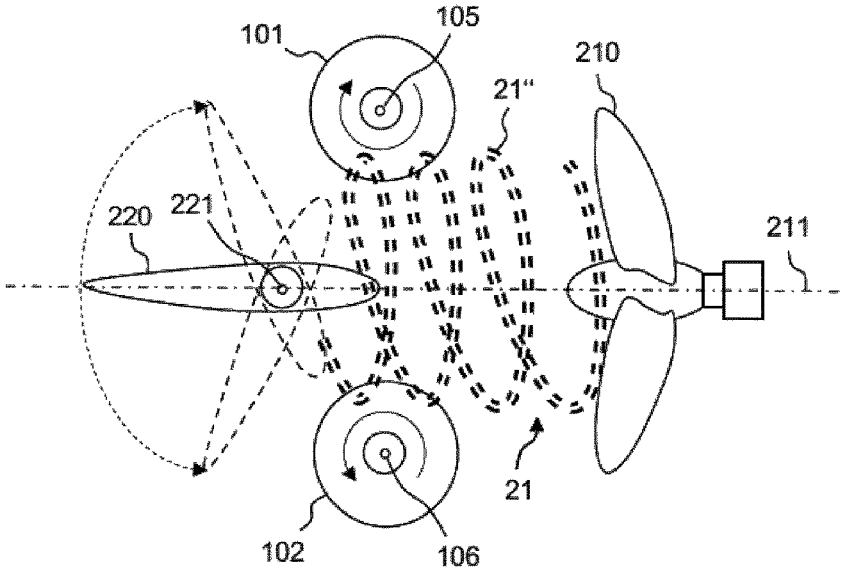

[Fig. 12]
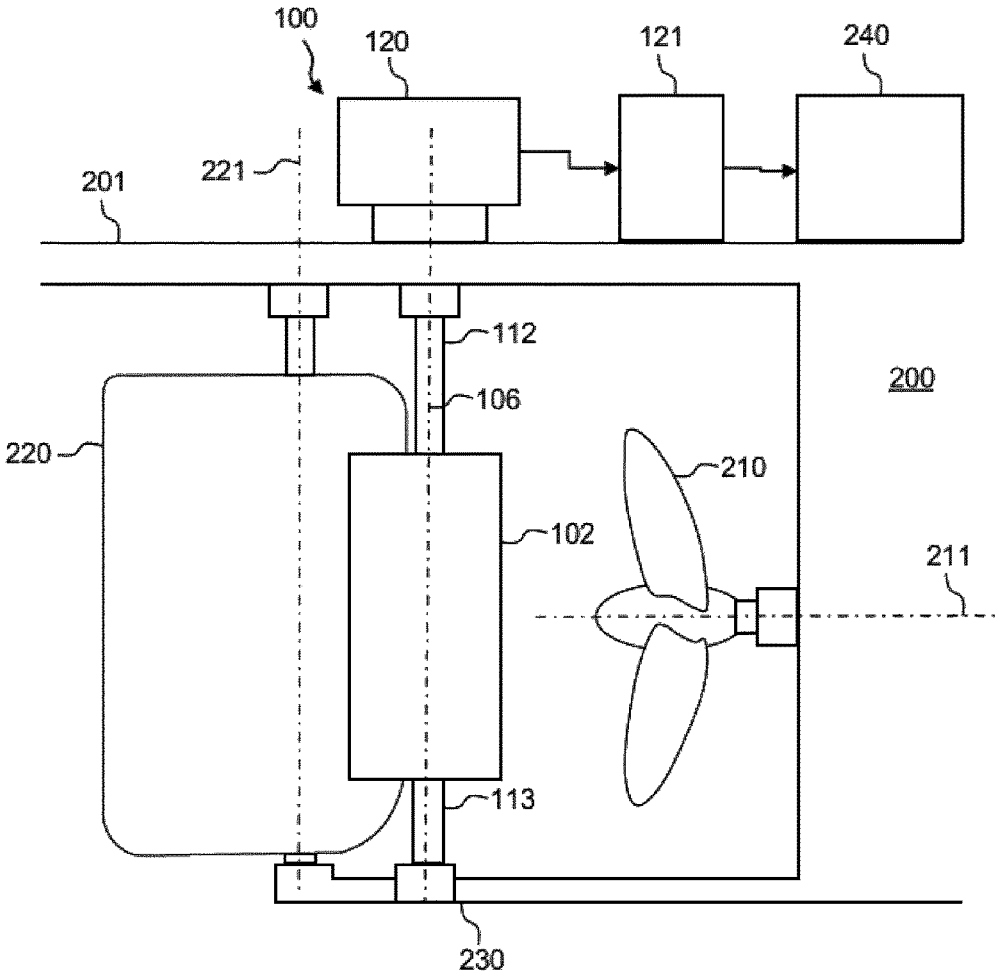
[Fig. 13]
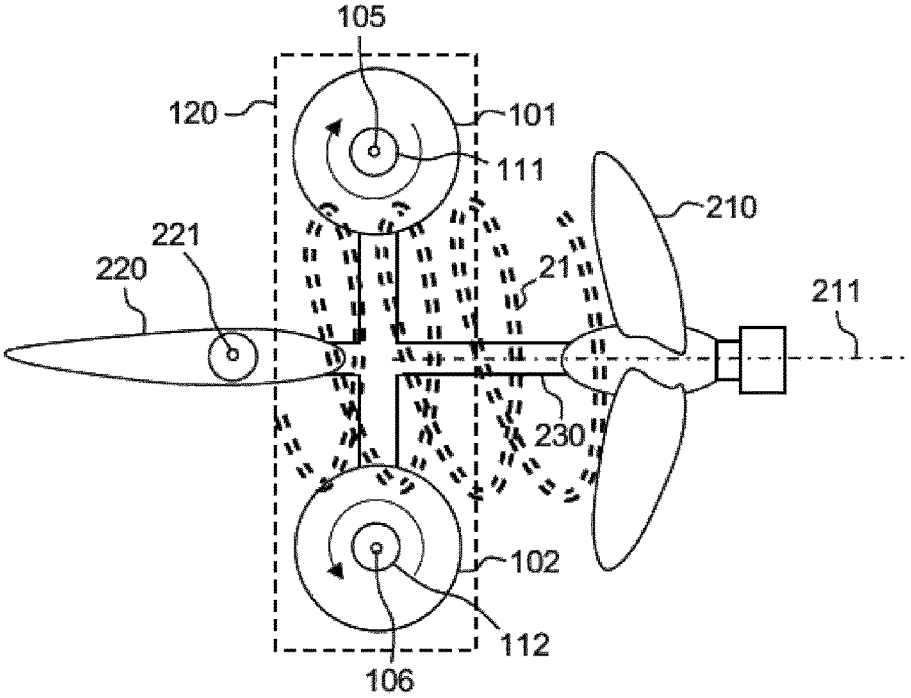

[Fig. 14]
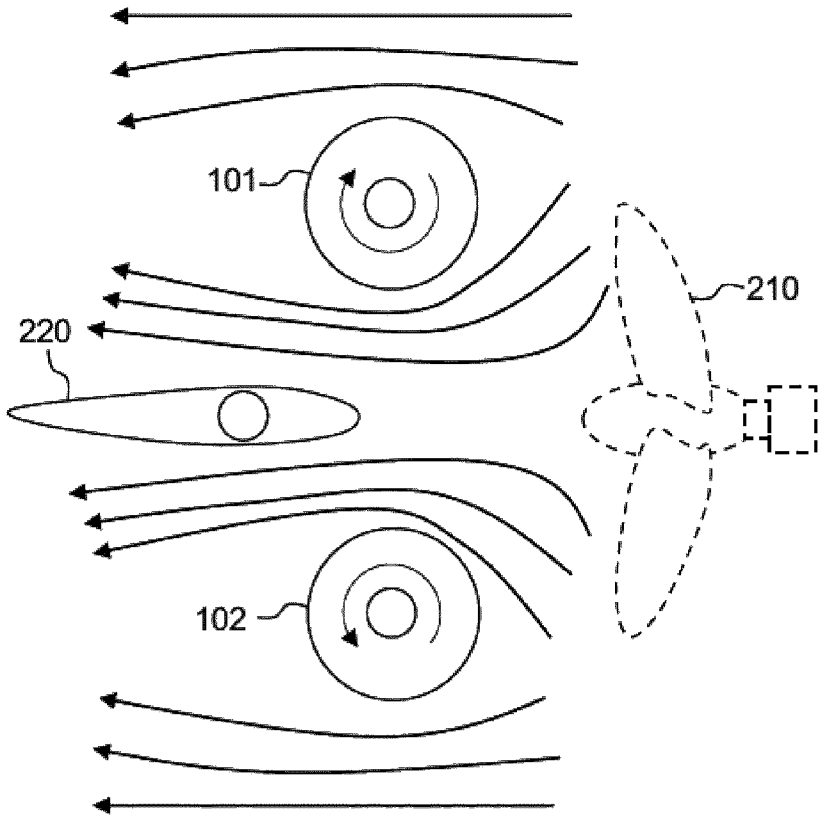
[Fig. 15]
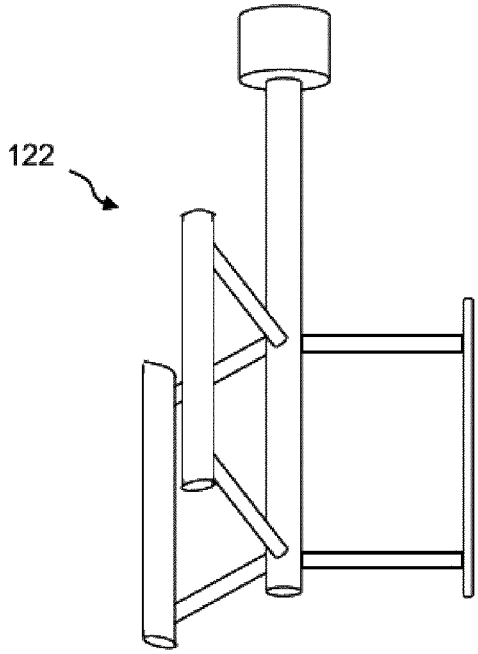

[Fig. 16]
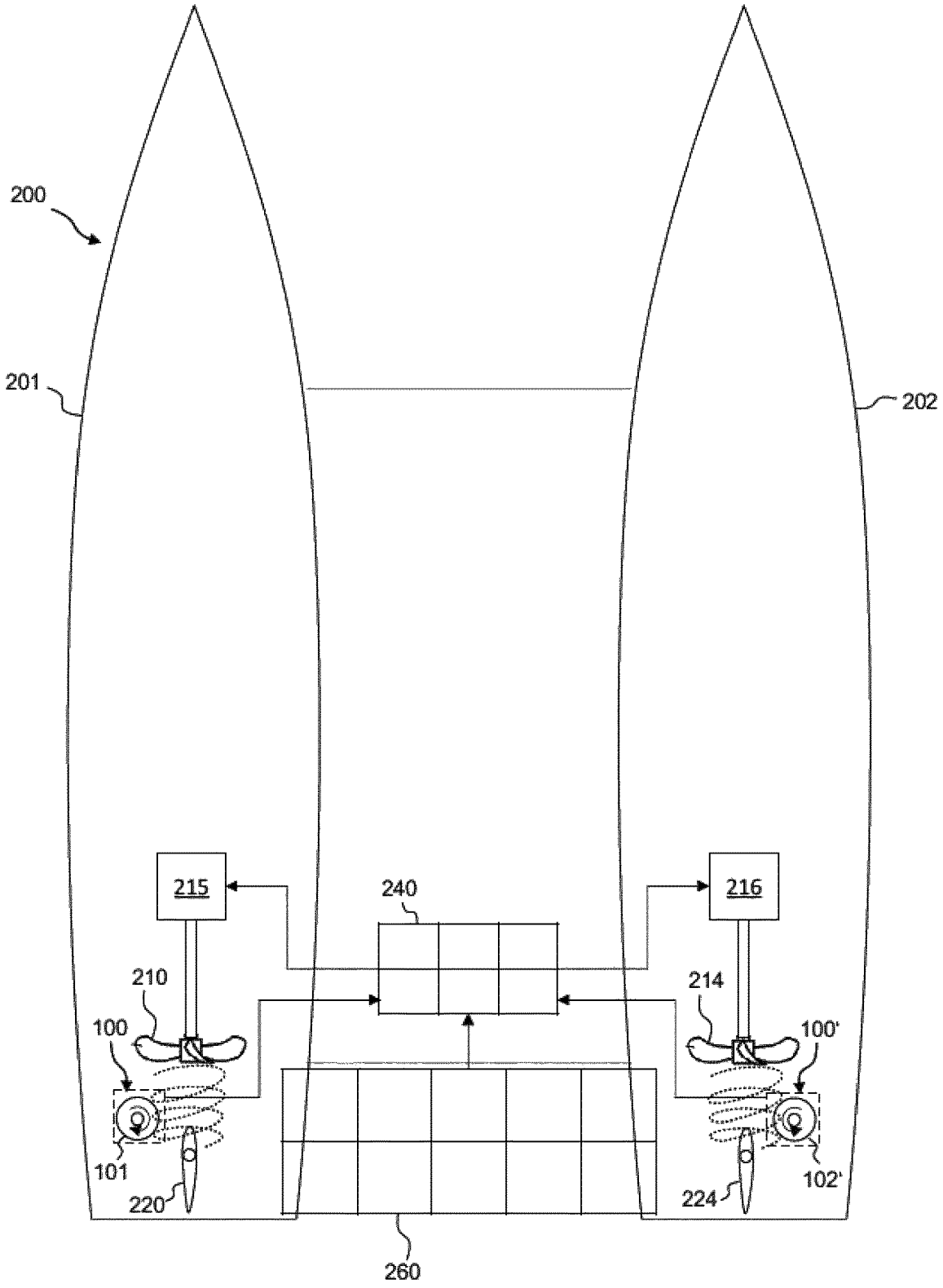

[Fig. 17]
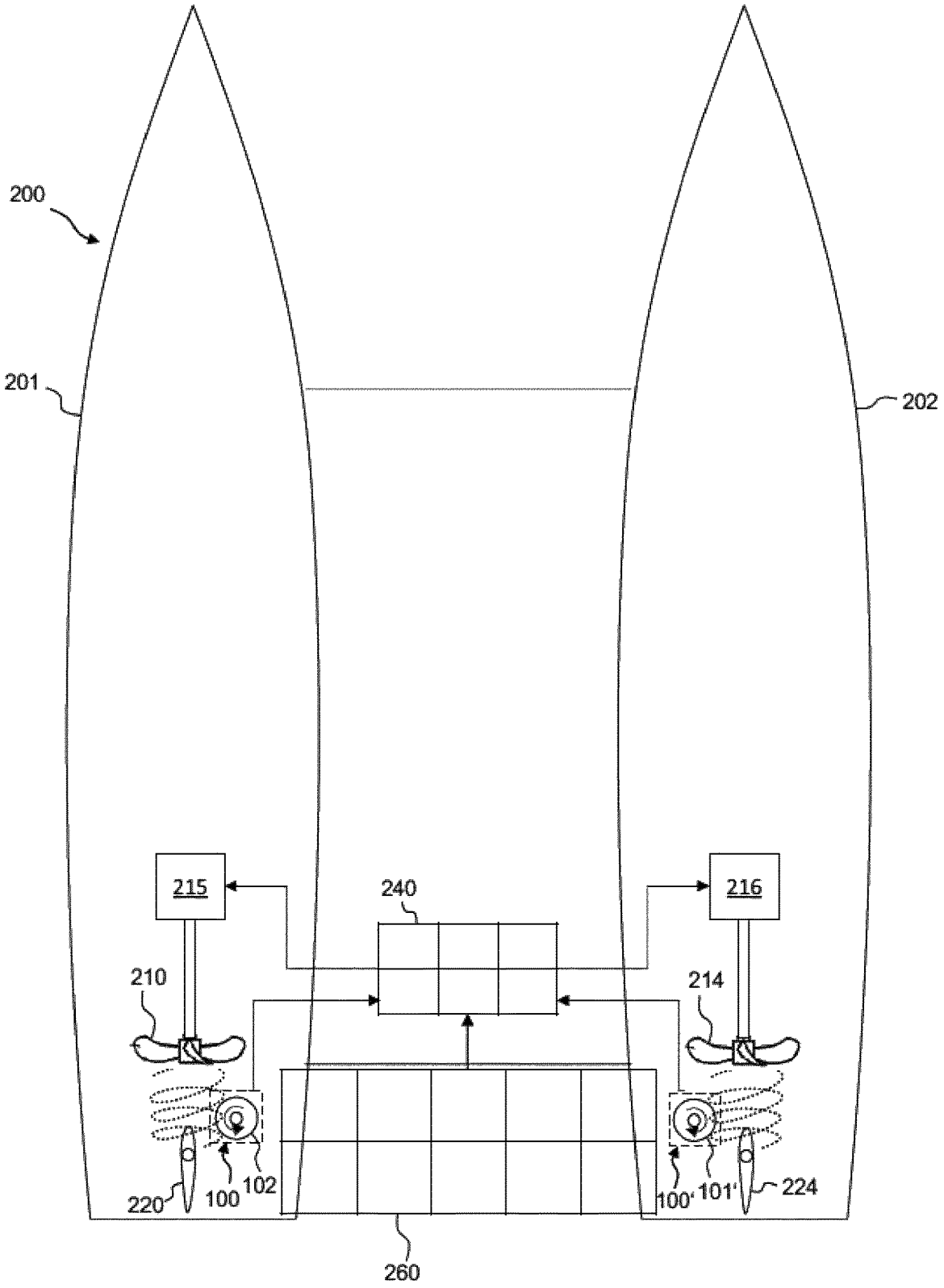

[Fig. 18]
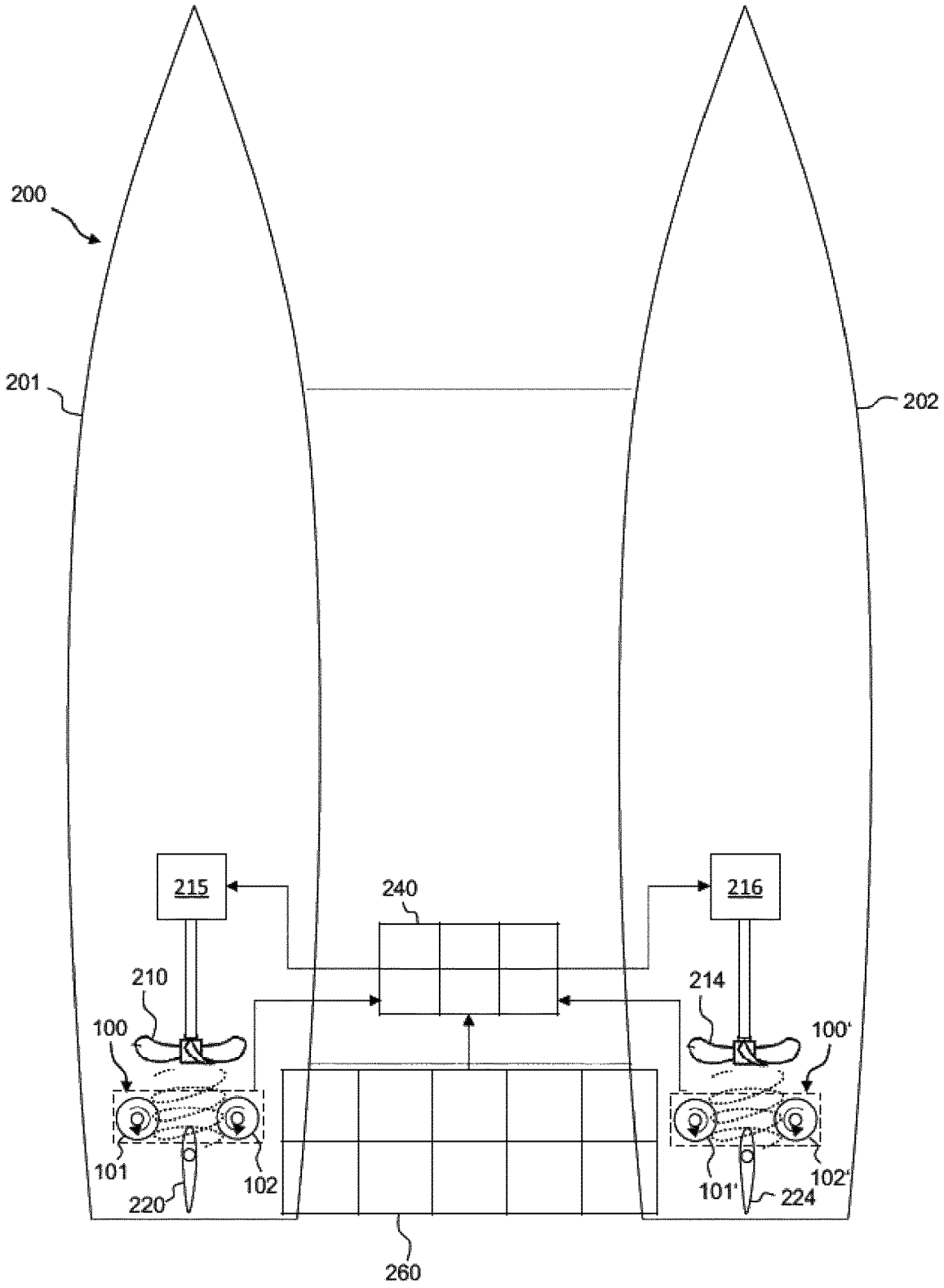

ENERGY RECOVERY SYSTEM FOR MARINE VESSELS

FIELD OF THE INVENTION

The present disclosure relates to an energy recovery system and method for recovering at least part of the energy dissipated by marine vessels using hydropower generation and to a marine vessel comprising such an energy recovery system.

BACKGROUND

Marine vessels rely on battery power storage for onboard instrumentation and electric appliances. Motorboats, using combustion engines, typically recharge the batteries by alternators coupled to the engines. A dedicated combustion generator may be also used, e.g. when the marine vessel is stationary over a prolonged period. The marine vessels may also comprise one or more complementary renewable energy sources, such as solar panels, wind turbines and hydro-generators.

The yachting industry like the automobile industry is evolving towards more ecological and sustainable solutions, which are based on the gradual replacement of combustion engines with electric motors and of fuel tanks with battery packs, thus using stored battery power also for propulsion, and almost exclusively renewable energy sources for recharging the batteries, thus significantly increasing the need for power storage, for fast and efficient recharging, and for efficient power management. Unlike combustion engines, electric motors are not coupled to alternators for recharging the batteries that are used to power them. Some of these vessels, especially those with a larger beam to length ratio, such as catamarans, can offer sufficient surface for installing solar panels and optionally wind turbines with sufficient power output for autonomous battery recharging. Current designs such as those from a leading manufacturer of solar yachts (Silent-Yachts) manage to achieve a power output of e.g. 17 Kwp on a 60-feet catamaran and 26 Kwp on a 80-feet catamaran, with solar panels alone, which can provide unlimited cruising range at certain vessel speeds, e.g. of about 6-8 Knots. A combustion-based generator is typically provided as a backup solution for battery recharging in case of prolonged cast sky over several days or when increased speed is required over a prolonged time.

Wind turbines in combination with solar panels do not typically bring a significant advantage, as they start to become efficient only at sustained wind speeds, while introducing injury risks, noise, and possibly reducing the efficiency of the solar panels by casting a shadow on them. Especially sailing downwind, in little apparent wind, a wind turbine's power output can be disappointing.

Hydro-generators can also be installed as renewable energy source on a vessel. The efficiency of a typical hydro-generator is however also comparatively low with respect to solar energy. The power output of a typical hydro-generator is e.g. about comparable to the power output of a single solar panel or less, e.g. in the range of a hundred to a few hundred W depending on size and vessel speed, for vessel speeds typically starting at 5 Knots at least, although contrary to wind and solar, which are not always available, as long as the vessel is sailing and maintaining a minimum speed, a hydro-generator can provide a stable and continuous output, e.g. also during night passages.

A hydro-generator is usually fastened on the transom of a vessel, attached to a lifting bracket, or fixedly under the hull of the vessel with power connection through the hull. It comprises a submerged leg ending with a torpedo-like housing comprising a propeller shaft and a generator coupled to the propeller shaft. The housing is filled with a lubricating oil. The propeller shaft is connected to a propeller and has a horizontal axis of rotation parallel to the longitudinal axis of the vessel, at a recommended depth between the water surface and the propeller axis of about 30 cm. The performance depends on the position and the quality of water flow in that position. It should therefore be placed as far as possible from the wake of appendages, such as rudders, sail drives and keel. In general, the greater the depth, the farther the propeller will be from the wake of the hull, and the better the performance of the hydro-generator. However, the longer the lever arm is, the greater the force on the mountings and during lifting will be for the version fastened to the transom. Also, the greater the depth the greater the drag force will be, affecting vessel speed. Also, the power generated depends on the size of the propeller and on the vessel speed, the bigger the propeller and the greater the vessel speed, the greater the power output. However, with increasing propeller size and vessel speed also the drag increases, causing a loss of vessel speed. The version fastened to the transom allows easier maintenance but is bulky and can be esthetically unpleasant, especially when lifted. The system is not designed to replace the engine's alternator, in case of combustion engines. It can nevertheless be used while operating the engine. However, electrical output can be significantly disrupted depending on the location of the hydro-generator and the water turbulence caused by the engine. The hydro-generator, in the version fastened to the transom, must be lifted when reversing the vessel in order to avoid any possible damage to the leg and cradle mountings.

Hydro-generators in their typical designs and operating mode, are thus typically useful, at least to some extent, only for some cruising vessels, typically sailing vessels, with limited solar energy capacity, which are mainly propulsed by wind on long passages.

In general, propellers used as vessel propulsors are configured to transform rotational power into linear thrust by acting upon water in order to move the vessel. However, only about 70-75% of the rotational power generated by the engine is transformed into linear thrust to move the vessel, the exact amount depending on parameters like vessel shape and size, propeller shape and size, water density, e.g. sweet or salty. The remaining part of the rotational power is dissipated partly as heat and partly in the formation of an accelerated vortical water flow in a wake of the propeller as a result of the propeller slip, that is the difference between the theoretical pitch, or linear distance that the propeller would advance through water upon one complete rotation if the water was a solid, and the effective distance advanced in the liquid medium.

Hydro-generators are typically designed to use power from the water flow resulting from the linear thrust alone as the vessel advances, positioned as far as possible from turbulences induced by the propeller, whereas there is theoretically more power to harness in the wake of a propeller where the hydrokinetic power of the water flow, relative to the moving vessel, includes also the power dissipated by the propeller in addition to the linear thrust. Concepts have thus been proposed that place a hydro-generator just behind (aft) the propulsion propeller with the hydro-generator propeller and the propulsion propeller facing each other and center aligned with each other such as disclosed e.g. in JPH11222188A, KR101323828B1 and CN107676214A1.

With such arrangements it is possible to recover at least part of the dissipated energy by using the tip vortices generated by the propulsion propeller to rotate the hydro-generator propeller. A problem with such arrangements is however the typical lack of space behind the propulsion propeller, as this is very often the place where a rudder is located. Moving the propeller and/or the rudder farther away from each other, even by design, is not always possible or efficient, because the space is often limited and also because steering efficiency may be affected. Thus, the above concepts require a modification of the rudder in order to integrate the hydro-generator in the rudder or by carving out part of the rudder to make space for it, which significantly increases the complexity of the system and possibly reduces steering efficiency. Another problem is the reduced accessibility of both propellers for maintenance. Another problem is the increased risk of jamming and damages by floating objects possibly remaining entangled between the two propellers. Another problem is the interference caused by the hydro-generator propeller to the propulsion propeller and the risk of damages in reverse mode. Another problem is the interference of the hydro-generator propeller with steering. Another problem is the increased drag, thus reducing the potential benefit.

GENERAL DESCRIPTION

In view of the above background, an energy recovery system for marine vessels is herein disclosed that enables to recover at least part of the dissipated rotational power from the accelerated vortical water flow in the wake of a propeller, while solving the space and accessibility problem, while remaining very simple and easy to install and while not interfering with an eventual rudder and with the steering efficiency. Another advantage is the reduced risk of jamming and damages by floating objects. Another advantage is the compatibility in reverse mode. Another advantage is the compactness, hence the minimal additional drag and the improved efficiency.

A marine vessel comprising such an energy recovery system and presenting the same advantages is herein also disclosed.

A method of recovering at least part of dissipated energy by marine vessels and presenting the same advantages is herein also disclosed.

Other advantages will become apparent from the following description.

In particular, an energy recovery system for a marine vessel is herein disclosed, the marine vessel comprising at least one marine propeller configured to transform rotational power into linear thrust by acting upon water in order to move the vessel, while at least part of the rotational power is dissipated in the formation of an accelerated vortical water flow in a wake of the propeller. In particular, the energy recovery system comprises at least one water turbine with vertical axis, rotatably fixed to a vessel hull and respectively arranged aft and off center, that is either port side or starboard side, with respect to a rotational axis of a respective propeller but at a distance from the propeller and from the rotational axis of the propeller such as to be at least partially in a wake range of the propeller in order to recover at least part of the dissipated rotational power from the accelerated vortical water flow.

The term "wake range" as used herein refers to the variable slip boundaries of the accelerated vortical flow past a propeller including tip vortices, said variable boundaries depending especially on propeller features like diameter, number and shape of the blades, pitch, and for a given propeller also on propeller speed and distance from the propeller. Numerous disclosures can be found in the literature describing models, simulations and studies of the flow past a rotating marine propeller such as e.g. in [Muscari R., Di Mascio A. *Numerical simulation of the flow past a rotating propeller behind a hull. Second International Symposium on Marine Propulsors—smp'*11, Hamburg, Germany, June 2011]; [Felli M., Camussi R. and Di Felice F.—*Mechanisms of evolution of the propeller wake in the transition and far fields. Journal of Fluid Mechanics* (2011) 682:5-53.]; [Muscari R., Di Mascio A. and Vericco R. *Modelling of vortex dynamics in the wake of a marine propeller. Computers & Fluids* (2013) 73:65-79] and are therefore not further elucidated herein.

The propeller wake velocity comprises components along axial, tangential, and radial directions. The wake can be divided in two major zones called respectively zone of flow establishment (ZFE) closer to the propeller and zone of established flow (ZEF) after the ZFE. Studies in the literature report that the extent of ZFE can be approximately up to x/Dp=2.63 downstream of a propeller wake, where "x" denotes longitudinal distance from the propeller, and "Dp" denotes the propeller diameter. The axial component of velocity, which is the velocity along the direction at that the wake propagates, is the major contributor to the total flow velocity in the wake range. Within the ZFE, the axial velocity distribution comprises two peaked ridges, having declining velocity towards the axis of rotation, due to the hub of the propeller, and towards the margins or slip boundaries of the wake, and highest velocity in between. As the wake propagates in the axial direction x, the peaks gradually migrate towards the axis of rotation until they merge into one in the ZEF, where the highest velocity is at the axis of rotation of the propeller.

A "Water turbine" can be very similar in design and function to a wind turbine using either drag and/or lift forces when placed in a fluid flow, such as an air flow for wind turbines or a water flow for water turbines, for rotating and thereby generating electrical power when coupled to a generator or alternator, typically a generator. Water turbines like wind turbines are typically divided in two major types, according to their axis of rotation, either horizontal or vertical. The hydro-generators referred to in the background session all use a propeller, as water turbine, with horizontal axis of rotation. On the contrary, according to the present disclosure the water turbine is a turbine with a vertical axis of rotation. Vertical axis turbines are typically categorized by their rotor type and different types are known like the Darrieus type, the Savonious type, the helical type, the H-Darrieus type such as summarized e.g. in [Khan, M. J., Bhuyan, G., Iqbal, M. T. and Quaicoe, J. E., *Hydrokinetic Energy Conversion Systems and assessment of Horizontal and Vertical Axis Turbines for River and Tidal Applications: A Technology Status Review, Applied Energy*, Vol. 86, No. 10, pp 1823-1835, 2009, https://doi.org/10.1016/j.apenergy.2009.02.017].

The governing equation for the conversion of the kinetic energy of the water flow into rotational mechanical energy that generates electricity is: $P=\frac{1}{2}\rho A V^3 C_p$, where P is the mechanical power extracted by the turbine in Watt [W], ρ is the density of water in $kg/m^3$ (slightly variable based on salinity and temperature), A is the area of the rotor blades in $m^2$, V is the fluid velocity in m/s and $C_p$ is the power coefficient, a measure of the fluid-dynamic efficiency of the turbine that depends on the electric system, mechanical system and blade hydrodynamic efficiency. It can be observed that the power generation increases with the cube of the velocity of the water flow, whereas the power output is only directly proportional to the blade surface. Thus, the ability to place the water turbine where the flow velocity is higher can be significantly advantageous, as it enables to generate more power while providing the opportunity to reduce the blade surface, rotor size and diameter, and hence to reduce drag.

According to an embodiment, the vertical axis of the at least one water turbine is at a distance from the rotational axis of the respective propeller, intended as a projection of the rotational axis of the propeller, at which about half of the rotor of the water turbine, in longitudinal cross-section, is in the wake range of the propeller. In particular, the vertical axis of the at least one water turbine may be suitably placed at a distance from the rotational axis of the respective propeller, intended as a projection of the rotational axis of the propeller, at which about half of the rotor of the water turbine, in longitudinal cross-section, is within the ZFE where the axial velocity is at peak. In this way, the maximum axial velocity can be used. Also, the relative velocity of the water flow acting on the side of the water turbine inside the wake of the propeller is higher than the relative velocity of the water flow acting on the other side of the water turbine outside of the wake of the propeller, which contributes to generate a greater and directional torque and hence a higher power efficiency.

According to an embodiment, the at least one water turbine is arranged in proximity and either port side or starboard side of a respective rudder, the rudder being arranged aft and center aligned with respect to the respective propeller, where the vertical axis of the at least one water turbine is at a distance from a vertical steering axis of the rudder that enables rudder deflection without interference by the at least one water turbine while enabling the at least one water turbine to be hit by tip vortices of the propeller wake before partial flow disruption by the rudder. The proximity of the at least one water turbine to the rudder has also the advantage to create a Venturi duct between the rudder and the at least one water turbine, while also taking advantage of the lift generated by the rudder shape, thereby causing the velocity of the water flow between the at least one water turbine and the rudder to be even higher, thus further increasing the directional torque and hence the power efficiency.

According to an embodiment, the at least one water turbine has a rotor with a height that is about the same or less of a diameter of the respective propeller and with a center horizontally aligned with the rotational axis of the respective propeller.

According to an embodiment, the at least one water turbine is a helical water turbine. Helical water turbines may be more efficient in conditions of turbulent/vortical water flow. Helical water turbines may be generating also less drag as they are designed to use substantially lift forces rather than drag forces for rotating. Other types of lift-based designs such as Darrieus or H-Darrieus may be suitably used as well. According to an embodiment, the helical water turbine is a Gorlov helical water turbine.

According to an embodiment, the at least one water turbine comprises blades twisted in one direction if the at least one water turbine is arranged port side with respect to the axis of rotation of the respective propeller and twisted in the opposite direction if the at least one water turbine is arranged starboard side with respect to the axis of rotation of the respective propeller, and where the direction of rotation of the at least one water turbine is respectively inverted. The direction of twist of the blades may be also dependent on the respective propeller walk, that is whether the propulsion propeller is right-handed or left-handed.

According to an embodiment, the blades of the at least one water turbine have a pitch that is about the same of the pitch of the blades of the respective propeller. This may contribute to maximize efficiency with the vortical flow and tip vortices acting like a sort of liquid mechanical screw on the helical blades of the at least one water turbine in a gear-type relationship.

According to an embodiment, the vertical axis of the at least one water turbine is orthogonal to the rotational axis of the respective propeller. In particular, the term "vertical" is herein used to include a certain tolerance, e.g. including deviations in a range of about +/−15 degrees from an upright orientation. Thus, in cases where the rotational axis of the propeller is inclined from an horizontal orientation of a certain angle, the vertical axis of the at least one water turbine may be, although not necessarily, also inclined of the same angle from a vertical orientation so that the rotational axis of the at least one water turbine is orthogonal to the rotational axis of the respective propeller.

According to an embodiment, the energy recovery system comprises at least one generator functionally coupled to an upper shaft of the at least one water turbine, where the at least one generator is arranged inside the vessel hull. Placing the generator inside the vessel hull, which is facilitated by having a water turbine with vertical axis, and having only the rotor and part of the shaft of the water turbine in the water contributes to reduce drag even further and makes any maintenance easier and more convenient. It is however of course also possible to have the generator integrated into a leg of the water turbine comprising the shaft, a solution which is anyway generally more compact and generating less drag compared to a propeller-based hydro-generator with horizontal axis. A generator external to the hull may have the advantage of not having rotating parts through the hull, but only electrical connection.

According to an embodiment, the at least one water turbine comprises a bottom shaft rotationally fixed to a sole piece. This solution may contribute to increase the mechanical stability of the water turbine and to reduce load on the hull.

According to an embodiment, the sole piece of the at least one water turbine is in common with the respective rudder, embodied e.g. as a lateral extension or arm or addon of the rudder sole piece in case of a rudder with steering axis rotationally fixed to a sole piece. This enables eventually to conveniently adapt and use existing structures.

A marine vessel comprising at least one energy recovery system according to any of the above embodiments is herein also disclosed.

A "marine vessel" according to the present disclosure is a vessel such as a boat, a yacht, a ship, a ferry or any other floating vessel, either monohull or multihull, adapted for navigation on water, such as ocean, sea, lake, river, regardless of its use, e.g. as a leisure vessel, or for commercial or dedicated use, e.g. as a charter yacht, a fishing boat, a ferry for transportation of people and/or other vehicles, a ship for transportation of goods, etc. . . . . In particular, the marine vessel of the present disclosure is a vessel provided with a motor-powered propulsion system as sole propulsion system or as main or complementary propulsion system, e.g. in addition to a wind propulsion system in case of sailing boats, the propulsion system comprising at least one marine propeller as propulsor. The at least one propeller is typically located aft at a fixed position and angle with respect to the vessel hull. According to an embodiment, the at least one propeller is connected to a respective inboard motor via a respective propeller shaft through the hull of the vessel.

According to an embodiment, the marine vessel comprises at least one electric motor to power the at least one propeller respectively. The energy recovery system of the present disclosure is particularly suitable for electrically propulsed marine vessels using stored battery power also for propulsion, and almost exclusively renewable energy sources, such as solar energy, for recharging the batteries, thus with significantly increased need for power storage, for fast and efficient recharging, and for efficient power management, including energy recovery. Such an energy recovery system can be particularly useful during night passages or cast days, by enabling to extend the cruising range and/or to maintain a certain cruising speed while reducing and possibly eliminating the need to use a back-up combustion generator in order to recharge the batteries until solar energy is again available.

According to an embodiment, the marine vessel comprises a port side propeller and a starboard side propeller and at least one port side energy recovery system and at least one starboard side energy recovery system. According to an embodiment, the at least one port side energy recovery system comprises a port side water turbine with respect to the port side propeller and the at least one starboard side energy recovery system comprises a starboard side water turbine with respect to the starboard propeller. According to an embodiment, the at least one port side energy recovery system comprises a starboard side water turbine with respect to the port side propeller and the at least one starboard side energy recovery system comprises a port side water turbine with respect to the starboard propeller. According to an embodiment, the at least one port side energy recovery system comprises a port side water turbine and a starboard side water turbine with respect to the port side propeller and the at least one starboard side energy recovery system comprises a port side water turbine and a starboard side water turbine with respect to the starboard propeller, respectively.

Thus a marine vessel with two propellers may comprise e.g. two or four water turbines symmetrically arranged with respect to the vessel.

Also, an energy recovery system may comprise one water turbine with a respective generator or two water turbines and in theory even more than two water turbines, e.g. coupled in parallel via a gear mechanism to a single terminal rotating shaft functionally coupled to a common generator, thus combining the power of a plurality of water turbines.

According to an embodiment, the marine vessel comprises a rechargeable battery pack as electric power supply for the at least one electric motor and at least one main renewable energy source for recharging the battery pack in addition to the at least one energy recovery system.

According to an embodiment the battery pack comprises lithium-ion cells, but any other types of rechargeable batteries may in principle be used. According to an embodiment, the at least one main renewable energy source is a photovoltaic system.

A method of recovering at least part of dissipated rotational power from an accelerated vortical water flow in a wake of a marine propeller configured to transform rotational power into linear thrust by acting upon water in order to move a marine vessel is herein also disclosed. The method comprises rotatably fixing to a hull of the vessel at least one water turbine with vertical axis, at a position that is aft and off center, that is either port side or starboard side, with respect to a rotational axis of the propeller but at a distance from the propeller and from the rotational axis of the propeller such as to be at least partially in a wake range of the propeller.

According to an embodiment, the method comprises rotationally fixing a bottom shaft of the at least one water turbine to a sole piece, the sole piece being optionally in common with a rudder of the vessel.

Other and further objects, features and advantages will appear from the following description of exemplary embodiments and accompanying drawings, which serve to explain the principles more in detail.

BRIEF DESCRIPTION OF THE DRAWINGS

FIG. 5 shows schematically characteristics of a wake of a marine propeller and a new energy recovery system according to the present disclosure and its arrangement with respect to the marine propeller and its wake, seen from the top.

FIG. 6 shows schematically the same energy recovery system of [FIG. 5] and its arrangement with respect to the marine propeller and its wake, seen from the side.

FIG. 7 shows schematically a perspective view of a water turbine and its arrangement with respect to a marine propeller and its wake, according to an embodiment of the present disclosure.

FIG. 8 shows schematically a variant of the embodiment of [FIG. 7] comprising two water turbines.

FIG. 9 shows schematically a top view of a water turbine and its arrangement with respect to a marine propeller and a rudder, according to an embodiment of the present disclosure.

FIG. 10 shows schematically a variant of the embodiment of [FIG. 9].

FIG. 11 shows schematically yet another variant of the embodiments of [FIG. 9] and [FIG. 10].

FIG. 12 shows schematically a side view of an energy recovery system and its arrangement with respect to a marine vessel, according to an embodiment, as well as a method of recovering energy.

FIG. 13 shows schematically a partial top view of the same embodiment of [FIG. 12].

FIG. 14 shows schematically some water flow characteristics around water turbines of the present disclosure in absence of propeller wake.

FIG. 15 shows schematically another example of water turbine type that could be employed.

FIG. 16 shows schematically a marine vessel comprising an energy recovering system according to an embodiment.

FIG. 17 shows schematically a variant of the embodiment of [FIG. 16].

FIG. 18 shows schematically yet another variant of the embodiment of [FIG. 16] and [FIG. 17].

Skilled artisans appreciate that elements in the figures are illustrated for simplicity and clarity and have not necessarily been drawn to scale. For example, the dimensions of some of the elements in the figures may be exaggerated relative to other elements whereas other elements may have been left out or represented in a reduced number in order to enhance clarity and improve understanding of the embodiments of the present disclosure.

DETAILED DESCRIPTION

Figure 1:
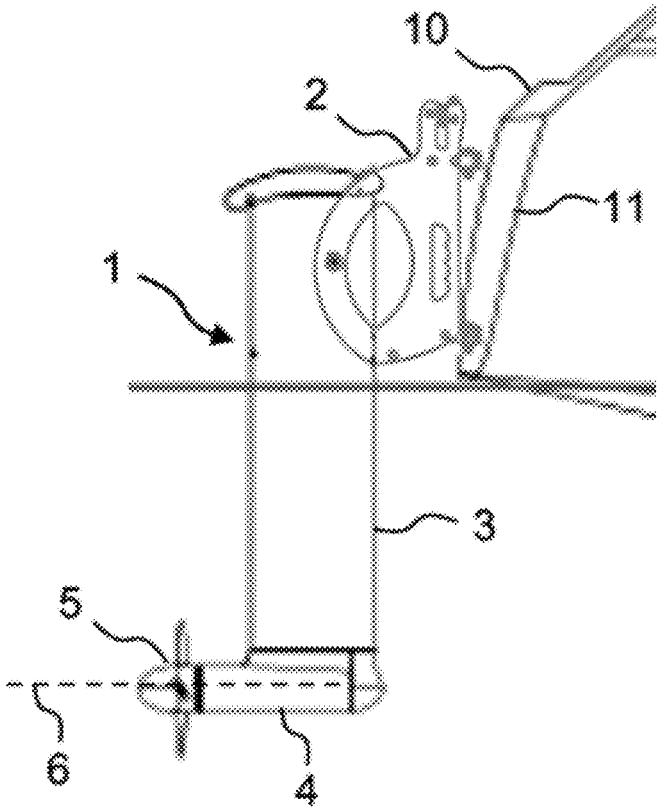
FIG. 1 PRIOR ART
FIG. 1 shows a hydro-generator known in the prior art fastened on the transom of a vessel.

[FIG. 1] shows a hydro-generator 1, known in the art, fastened via a lifting bracket 2 on the transom 11 of a marine vessel 10. The hydro-generator 1 comprises a submerged leg 3 ending with a torpedo-like housing 4 comprising a propeller shaft and a generator coupled to the propeller shaft (not shown). The propeller shaft is connected to a propeller 5 and has a horizontal axis of rotation 6 parallel to the longitudinal axis of the vessel 10.

Figure 2:
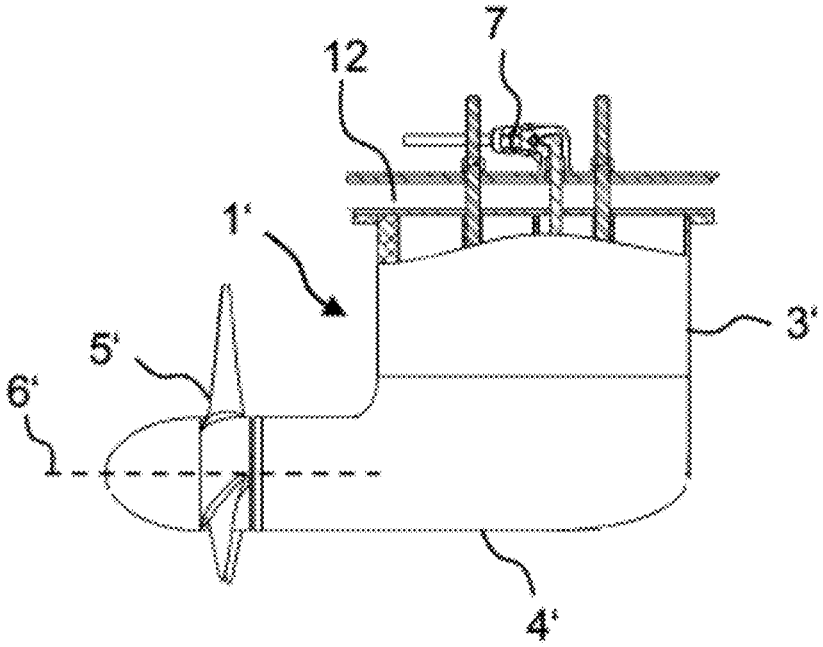
FIG. 2 PRIOR ART
FIG. 2 shows a similar type of hydro-generator as in [FIG. 1], also known in the prior art, designed to be fixed under the hull of a vessel.

[FIG. 2] shows a hydro-generator 1' similar to the hydro-generator 1 of [FIG. 1], and also known in the art, designed to be fixed under the hull 12 of a vessel, with power connection 7 through the hull 12. The hydro-generator 1' also comprises a submerged shortened leg 3' ending with a torpedo-like housing 4' comprising a propeller shaft and a generator coupled to the propeller shaft (not shown), and a propeller 5' with a horizontal axis of rotation 6' parallel to the longitudinal axis of the vessel.

Figure 3:
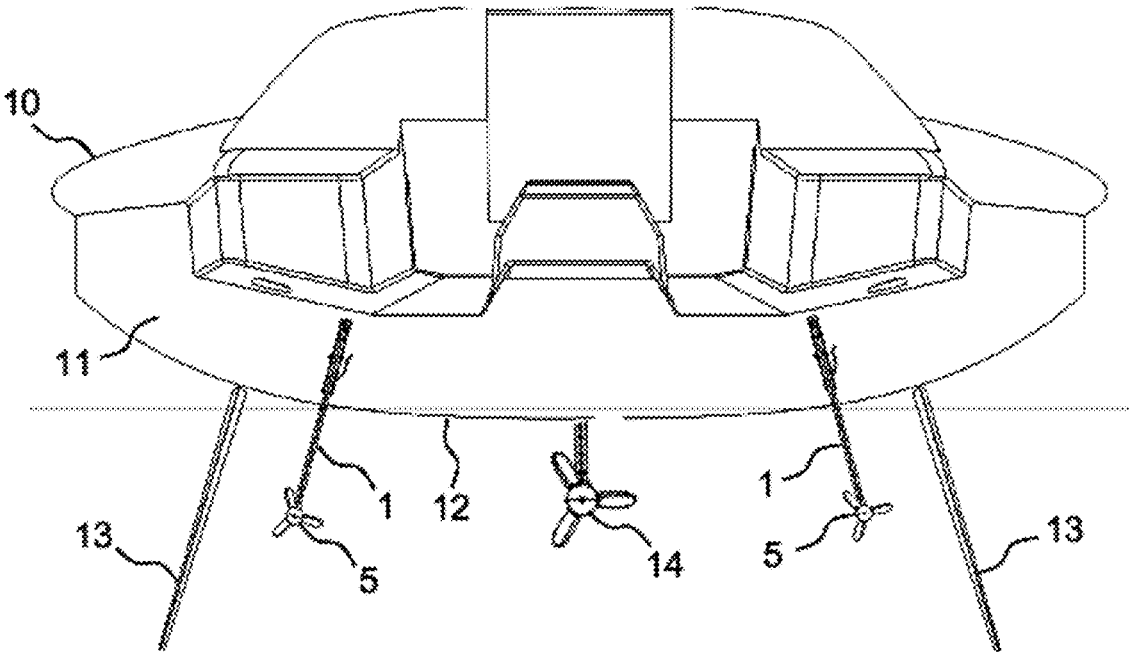
FIG. 3 PRIOR ART
FIG. 3 shows a typical installation of the hydro-generator of [FIG. 1], as known in the prior art.

[FIG. 3] shows a typical installation of the hydro-generator 1 of [FIG. 1], as known in the art. In particular, two hydro-generators 1 of the type shown in [FIG. 1], are installed at the transom 11 of a vessel 10 such that the respective propellers 5 are at a depth and lateral position with respect to the transom 11 such that they are outside of the wake of rudders 13, of the wake of the hull 12 itself and especially out of the wake of the vessel propeller 14, particularly when this is used to propel the vessel 10. This is because the performance of such a hydro-generator 1 depends on the quality of the water flow, which should be possibly free from any turbulence. The type of hydro-generator 1' shown in [FIG. 2] is typically placed under the hull centrally with respect to the hull 12 but forward with respect to the vessel propeller 14 for the same reason (not shown).

Figure 4:
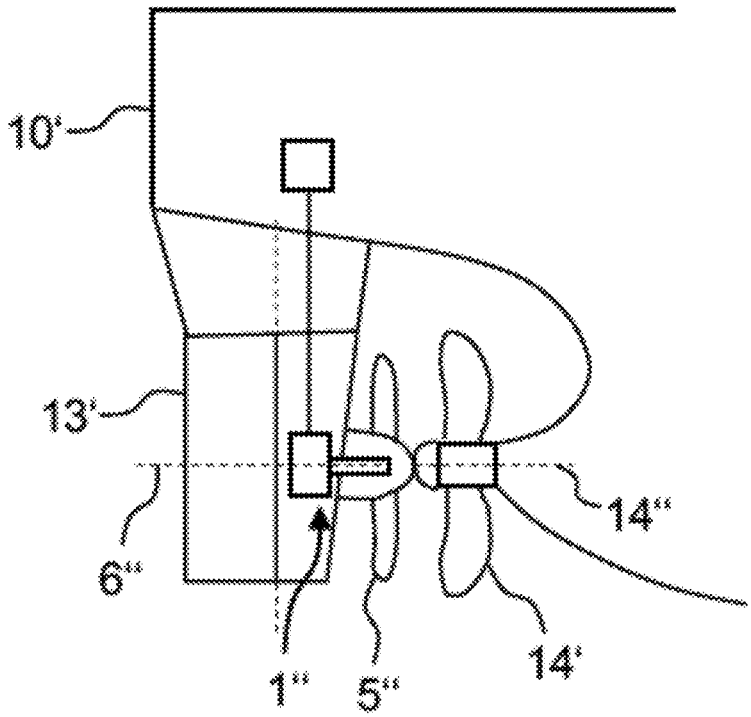
FIG. 4 PRIOR ART
FIG. 4 shows another prior art hydro-generator installed just behind a propulsion propeller.

[FIG. 4] shows another type of hydro-generator 1" known in the prior art, e.g. as disclosed in CN107676214A1. The hydro-generator 1" is partly integrated into the rudder 13' of a marine vessel 10' with the hydro-generator propeller 5" placed just behind (aft) and facing the vessel propeller 14', center aligned with each other and with respective axes of rotation 6", 14" in line with each other. With such arrangement it is possible to recover at least part of the dissipated energy by using the tip vortices generated by the propulsion propeller 14' to rotate the hydro-generator propeller 5". This concept has however a series of disadvantages already mentioned in the background session.

[FIG. 5] and [FIG. 6] taken together show schematically some characteristics of a wake 21 of a marine propeller 210 and a new energy recovery system 100 according to the present disclosure and its arrangement with respect to the marine propeller 210 and its wake 21, seen from the top and from the side respectively. In particular, [FIG. 5] shows a cross section of the wake 21 in a xy plane passing through the center of the propeller 210, where x is the axial direction and y is the tangential direction, whereas [FIG. 6] shows an orthogonal cross section of the wake 21 in a xz plane passing through the center of the propeller 210, where x is the axial direction and z is the radial direction, the propeller 210 having an axis of rotation 211 parallel to the axial direction x. The velocity of the propeller wake 21 comprises components along the axial x, tangential y, and radial z directions, resulting in an accelerated vortical water flow past the propeller 210 due to dissipated rotational power by the propeller 210. The wake 21 can be divided in two major zones called respectively zone of flow establishment (ZFE) closer to the propeller 210 and zone of established flow (ZEF) further from the propeller 210, past the ZFE. Studies in the literature report that the extent of ZFE can be approximately up to x/Dp=2.63 downstream of a propeller wake, where "x" denotes the longitudinal distance from the propeller along the axial direction x, and "Dp" denotes the diameter of the propeller 210. The axial component of the wake velocity $V_x$, is the major contributor to the total flow velocity in the wake range, that is within the slip boundaries 21' of the wake 21. Within the ZFE, the axial velocity $V_x$ distribution comprises two peaked ridges, having declining velocity towards the axis of rotation 211, due to the hub 212 of the propeller 210, and towards the slip boundaries 21' of the wake 21, and highest velocity in between $V_{x\text{-}max}$. As the wake propagates in the axial direction x, the peaks gradually migrate towards the axis of rotation 211 until they merge into one in the ZEF, where the highest velocity $V_{x\text{-}max}$ is at the axis of rotation 211 of the propeller 210. The water flow velocity, within the slip boundaries 21' of the wake 21, relative to a moving vessel under propeller propulsion and relative to any water turbine moving with the vessel, includes the axial wake velocity $V_x$ and the water flow velocity due to the useful conversion of the propeller rotation power into linear thrust, as the vessel moves, that is the same as the vessel velocity but in opposite direction. Thus, for a moving marine vessel, under propeller propulsion, $V_x$ is the difference in axial water flow velocity between the inside of the slip boundaries 21' of the wake 21 and the outside of the slip boundaries 21' of the wake 21, where the water flow velocity relative to the moving vessel is a result of the linear thrust only. The energy recovery system 100 comprises at least one water turbine 101, 102 with vertical axis 105, 106 (parallel to the z direction), rotatably fixed to a vessel hull (not shown in [FIG. 5] and [FIG. 6]) and respectively arranged aft and off center, that is either port side or starboard side, with respect to the rotational axis 211 of the propeller 210 but at a distance from the propeller 210 and from the rotational axis 211 of the propeller 210 such as to be at least partially in a wake range 21 of the propeller 210, and more particularly at least partially in the zone of flow establishment (ZFE), possibly where the axial velocity is maximum $V_{x\text{-}max}$ tangential to the water turbine rotor 103, 104, in order to recover as much as possible of the dissipated rotational power. In particular, [FIG. 5] shows two water turbines 101, 102 from the top arranged aft and off center, respectively port side 101 and starboard side 102, with respect to the rotational axis 211 of the propeller 210, with about half of their respective rotors 103, 104 in the ZFE of the wake 21, that is with their respective vertical axes 105, 106 at a distance from the rotational axis 211 of the propeller 210 that is about the same as the radius (Dp/2) of the propeller.

As can be seen from the side view in [FIG. 6], the at least one water turbine 101 (the starboard side water turbine 102 being hidden behind the portside water turbine 101 and hence not visible in [FIG. 6]) has a rotor 103 with a height that is about the same (in this case) or less of the diameter Dp of the propeller 210 and has a center 107 horizontally aligned with the rotational axis 211 of the propeller 210.

[FIG. 7] shows schematically a perspective view of a water turbine 101 with vertical axis 105 and its arrangement with respect to a marine propeller 210 and its wake 21, portside with respect to the axis of rotation 211 of the propeller 210. The propeller 210 is in this example right-handed, that is it generates a forward linear thrust when it rotates clockwise. The wake 21 is represented here schematically as a three-dimensional vortical flow including tip vortices 21" resulting from the clockwise rotational motion of the propeller 210 and including velocity components in the axial x, tangential y and radial z directions.

[FIG. 8] shows schematically a variant of the embodiment of [FIG. 7] comprising two water turbines 101, 102, with vertical axes 105, 106, respectively portside 101 and starboard side 102 with respect to the axis of rotation 211 of the propeller 210, like in the embodiment of [FIG. 5] and [FIG. 6].

The water turbines 101, 102 of [FIG. 7] and [FIG. 8] are helical water turbines, and in particular of the Gorlov type. In particular, the portside water turbine 101 comprises blades 109 twisted in one direction whereas the starboard side water turbine 102 comprises blades 108 twisted in the opposite direction. The respective direction of twist of the blades 108, 109 depends primarily on the propeller walk, right-handed in this case, and it could have been inverted in case the propeller 210 was left-handed. It is also to be noted that the directions of rotation of the portside water turbine 101 and of the starboard side water turbine 102 are respectively inverted, as effect of the water flow 21, 21" and their respective arrangement and design with respect to the water flow 21, 21".

[FIG. 9] shows schematically a top view of a water turbine 101 with vertical axis 105 and its arrangement with respect to a marine propeller 210 and a rudder 220, that is port side with respect to the rotational axis 211 of the propeller 210 and with respect to the rudder 220, the rudder 220 being arranged aft and center aligned with respect to the propeller 210. The water turbine 101, the propeller 210 and the wake 21 are the same as in [FIG. 7]-8, seen from the top (schematically).

[FIG. 10] shows schematically a variant of the embodiment of [FIG. 9], with the difference that instead of the water turbine 101 on the port side, a water turbine 102, like the water turbine of [FIG. 8], is arranged on the starboard side, with respect to the rotational axis 211 of the propeller 210 and with respect to the rudder 220.

[FIG. 11] shows schematically yet another variant of the embodiments of [FIG. 9] and [FIG. 10] with both the water turbine 101 and the water turbine 102 respectively arranged on the port side and the starboard side, with respect to the rotational axis 211 of the propeller 210 and with respect to the rudder 220. In particular, the rotational axes 105, 106 of the water turbines 101, 102 respectively are at a distance from a vertical steering axis 221 of the rudder 220 that enables rudder deflection without interference by the water turbines 101, 102 while enabling the water turbines to be hit by tip vortices 21" of the propeller wake 21 before partial flow disruption by the rudder 220.

[FIG. 12] and [FIG. 13] taken together show schematically a side view and a partial top view respectively of an energy recovery system 100 and its arrangement with respect to a marine vessel 200, according to an embodiment. The energy recovery system 100 comprises two water turbines 101, 102 with respective vertical axis 105, 106 respectively arranged on the port side and the starboard side, with respect to the rotational axis 211 of a vessel propeller 210 and steering axis 221 of a rudder 220, like in the embodiment of [FIG. 11]. The energy recovery system 100 further comprises one or two generators 120 functionally coupled to the upper shafts 111, 112 of the water turbines 101, 102, where the at least one generator 120 is arranged inside the vessel hull 201, an option that is enabled by having water turbines with vertical axis. The generator 120 may be connected to an inverter 121 before the generated electrical current is returned to a battery 240 as recovered energy. The water turbines 101, 102 each comprise also a bottom shaft 113 rotationally fixed to a sole piece 230 for increased stability. In particular, the sole piece 230 is in common with the rudder 220, for convenience. Still in connection with [FIG. 12] and [FIG. 13], a method of recovering at least part of dissipated rotational power from an accelerated vortical water flow in a wake 21 of a marine propeller 210 configured to transform rotational power into linear thrust by acting upon water in order to move a marine vessel 200 is herein also disclosed. The method comprises rotatably fixing to a hull 201 of the vessel 200 at least one water turbine 101, 102 with vertical axis 105, 106, at a position that is aft and off center, that is either port side or starboard side, with respect to a rotational axis 211 of the propeller 210 but at a distance from the propeller 210 and from the rotational axis 211 of the propeller 210 such as to be at least partially in a wake range 21 of the propeller 210. The illustrated method further comprises rotationally fixing a bottom shaft 113 of the at least one water turbine 101, 102 to a sole piece 230, the sole piece 230 being in common with the rudder 220.

[FIG. 14] shows schematically some water flow characteristics around water turbines 101, 102 of the present disclosure also in absence of propeller wake, when e.g. a vessel is propelled, at least temporarily, by other means other than the propeller, e.g. by wind in case of a sailing vessel. In particular, the proximity to the rudder 220 can have the advantage to create a Venturi duct between the at least one water turbine 101, 102 and the rudder 220, while also taking advantage of the lift generated by the rudder shape, thereby causing the velocity of the water flow between the at least one water turbine 101, 102 and the rudder 220 to be higher than on the external side of the at least one water turbine 101, 102, even when not using the propeller 210, and even higher when using the propeller 210, thus further increasing the directional torque and hence the power efficiency.

[FIG. 15] shows schematically another example of water turbine type with vertical axis and lift-based design that could be employed, and in particular a H-Darrieus water turbine 122. Of course, like for the helical water turbine, the size of the rotor, and the number and shape of the hydrofoil blades may be suitably adapted according to vessel and propeller type and e.g. typical cruising speed.

[FIG. 16] shows schematically a marine vessel 200 and in particular a catamaran with a port side hull 201 and a starboard side hull 202, comprising a port side electric motor 215 and a starboard side electric motor 216, respectively connected to a port side propeller 210 and to a starboard side propeller 214, a rechargeable battery pack 240 as electric power supply for the electric motors 215, 216 and a photovoltaic system 260 as main renewable energy source for recharging the battery pack 240. The marine vessel 200 further comprises a port side rudder 220 and a starboard side rudder 224 located aft of and center aligned with the respective propellers 210, 214. In particular, the marine vessel 200 comprises a port side energy recovery system 100 and a starboard side energy recovery system 100' according to any of the disclosed embodiments, where the at least one port side energy recovery system 100 comprises a port side water turbine 101 with respect to the port side propeller 210 and the starboard side energy recovery system 100' comprises a starboard side water turbine 102' with respect to the starboard side propeller 214, thus symmetrically arranged with respect to the vessel 200.

[FIG. 17] shows schematically the same marine vessel 200 of [FIG. 16], with the difference that the port side energy recovery system 100 comprises a starboard side water turbine 102 with respect to the port side propeller 210 and the starboard side energy recovery system 100' comprises a port side water turbine 101' with respect to the starboard side propeller 214, thus still symmetrically arranged with respect to the vessel 200.

[FIG. 18] shows schematically the same marine vessel 200 of [FIGS. 16]-17, with the difference that the port side energy recovery system 100 comprises a port side water turbine 101 and a starboard side water turbine 102 with respect to the port side propeller 210 and the starboard side energy recovery system 100' comprises a port side water turbine 101' and a starboard side water turbine 102' with respect to the starboard side propeller 214.

With reference to all embodiments of [FIGS. 16]-18, the energy recovery systems 100, 100' and respective water turbines (101, 102, 101', 102') may be identical to each other with the exception eventually of the direction of twist of the water turbine blades depending on the arrangement of the water turbine either port side or starboard side of the respective propeller (210, 214) and on the walk of the propeller (210, 214) that may be both right-handed, or both left-handed, or one left-handed and one right-handed respectively.

In the preceding specification, numerous specific details are set forth in order to provide a thorough understanding of the present disclosure. It will be apparent, however, to one having ordinary skill in the art that the specific detail need not be employed to practice the present teaching. In other instances, well-known materials, parts or methods have not been described in detail in order to avoid obscuring the present disclosure.

Particularly, modifications and variations of the disclosed embodiments are certainly possible in light of the above description. It is therefore to be understood, that within the scope of the appended claims, the invention may be practiced otherwise than as specifically devised in the above examples.

Reference throughout the preceding specification to "one embodiment", "an embodiment", "one example" or "an example", means that a particular feature, structure or characteristic described in connection with the embodiment or example is included in at least one embodiment. Thus, appearances of the phrases "in one embodiment", "in an embodiment", "one example" or "an example", in various places throughout this specification are not necessarily all referring to the same embodiment or example.

Furthermore, the particular features, structures, or characteristics may be combined in any suitable combinations and/or sub-combinations in one or more embodiments or examples.

The invention claimed is:

1. An energy recovery system for a marine vessel, the marine vessel comprising at least one marine propeller configured to transform rotational power into linear thrust by acting upon water in order to move the vessel, while at least part of the rotational power is dissipated in the formation of an accelerated vortical water flow in a wake of the propeller, wherein the energy recovery system comprises at least one water turbine with vertical axis rotatably fixed to a vessel hull and respectively arranged aft and off center, that is either port side or starboard side, with respect to a rotational axis of a respective propeller but at a distance from the propeller and from the rotational axis of the propeller such as to be at least partially in a wake range of the propeller in order to recover at least part of the dissipated rotational power from the accelerated vortical water flow.

2. The energy recovery system of claim 1 wherein the vertical axis of the at least one water turbine is at a distance from the rotational axis of the respective propeller that is about the same as a radius of the propeller.

3. The energy recovery system of claim 1 wherein the at least one water turbine is arranged in proximity and either port side or starboard side of a respective rudder, the rudder being arranged aft and center aligned with respect to the respective propeller, wherein the rotational axis of the at least one water turbine is at a distance from a vertical steering axis of the rudder that enables rudder deflection without interference by the at least one water turbine while enabling the at least one water turbine to be hit by tip vortices of the propeller wake before partial flow disruption by the rudder.

4. The energy recovery system according to claim 1 wherein the at least one water turbine has a rotor with a height that is about the same or less of a diameter (Dp) of the respective propeller and with a center horizontally aligned with the rotational axis of the respective propeller.

5. The energy recovery system according to claim 1 wherein the at least one water turbine is a helical water turbine.

6. The energy recovery system according to claim 5 wherein the at least one water turbine comprises blades twisted in one direction if the at least one water turbine is arranged port side with respect to the axis of rotation of the respective propeller and blades twisted in the opposite direction if the at least one water turbine is arranged starboard side with respect to the axis of rotation of the respective propeller, and wherein the direction of rotation of the at least one water turbine is respectively inverted as effect of the water flow.

7. The energy recovery system according to claim 1 comprising at least one generator functionally coupled to an upper shaft of the at least one water turbine, wherein the at least one generator is arranged inside the vessel hull.

8. The energy recovery system according to claim 1 wherein the at least one water turbine comprises a bottom shaft rotationally fixed to a sole piece.

9. The energy recovery system according to claim 8 wherein the sole piece of the at least one water turbine is in common with a respective rudder.

10. A marine vessel comprising at least one energy recovery system according to claim 1.

11. The marine vessel of claim 10 comprising at least one electric motor to power the at least one propeller respectively.

12. The marine vessel according to claim 10 comprising a port side propeller and a starboard side propeller and at least one port side energy recovery system and at least one starboard side energy recovery system, wherein the at least one port side energy recovery system comprises a port side water turbine with respect to the port side propeller and the at least one starboard side energy recovery system comprises a starboard side water turbine with respect to the starboard side propeller, or the at least one port side energy recovery system comprises a starboard side water turbine with respect to the port side propeller and the at least one starboard side energy recovery system comprises a port side water turbine with respect to the starboard side propeller, or the at least one port side energy recovery system comprises a port side water turbine and a starboard side water turbine with respect to the port side propeller (210) and the at least one starboard side energy recovery system comprises a port side water turbine and a starboard side water turbine with respect to the starboard side propeller.

13. The marine vessel-according to claim 11 further comprising a rechargeable battery pack as electric power supply for the at least one electric motor and at least one main renewable energy source for recharging the battery pack in addition to the at least one energy recovery system.

* * * * *